United States Patent [19]

Streeper

[11] 4,090,877

[45] May 23, 1978

[54] PHOTOSENSITIVE IMAGEABLE COMPOSITION CONTAINING A HEXAAROMATICBIMIDAZOLE, A LEUCO DYE AND AN OXYGEN-SENSITIZING COMPOUND

[75] Inventor: Richard D. Streeper, Woodbury, Minn.

[73] Assignee: Minnesota Mining and Manufacturing Company, St. Paul, Minn.

[21] Appl. No.: 824,733

[22] Filed: Aug. 15, 1977

Related U.S. Application Data

[63] Continuation of Ser. No. 634,619, Nov. 24, 1975, abandoned.

[51] Int. Cl.[2] ..... G03C 1/52; G03C 5/04

[52] U.S. Cl. ..... 96/27 E; 96/48 R; 96/87 R; 96/90 R

[58] Field of Search ..... 96/90 R, 27 E, 87 R, 96/88, 48 R

[56] References Cited

U.S. PATENT DOCUMENTS

| | | | |
|---|---|---|---|
| 3,042,515 | 7/1962 | Wainer | 96/90 R |
| 3,390,994 | 7/1968 | Cescon | 96/48 R |
| 3,563,750 | 2/1971 | Walker | 96/90 R |
| 3,754,921 | 8/1973 | Riesder | 96/90 R |
| 3,799,779 | 3/1974 | Burleigh | 96/88 |
| 3,920,457 | 11/1975 | Cunningham et al. | 96/90 R |

*Primary Examiner*—Won H. Louie, Jr.

*Attorney, Agent, or Firm*—Cruzan Alexander; Donald M. Sell; James V. Lilly

[57] ABSTRACT

An imageable composition comprising (a) a leuco form of dye, (b) a hexaaromaticbiimidazole that effects the conversion of said dye to a differently colored compound when exposed to electromagnetic radiation at a wavelength of from about 250 to 400 nanometers, and (c) an oxygen sensitizing compound in an amount such that, upon exposure to electromagnetic radiation at a wavelength of from about 400 to 700 nanometers in the presence of oxygen, said dye is stabilized in its leuco form.

25 Claims, No Drawings

PHOTOSENSITIVE IMAGEABLE COMPOSITION CONTAINING A HEXAAROMATICBIIMIDAZOLE, A LEUCO DYE AND AN OXYGEN-SENSITIZING COMPOUND

This is a continuation, of application Ser. No. 634,619 filed Nov. 24, 1975, now abandoned.

BACKGROUND OF THE INVENTION

This invention relates to imageable compositions and to methods of utilizing said compositions. More particularly, it relates to imageable compositions capable of forming color when exposed to electromagnetic radiation in one wavelength range and capable of being stabilized against color formation when exposed to electromagnetic radiation in a different wavelength range.

The use of radiation sensitive compositions to form colored images has previously been suggested (e.g., see U.S. Pat. Nos. 3,390,994; 3,390,996 and 3,658,543). The compositions disclosed in these patents comprise a leuco form of dye, a photooxidant, and a combination of oxidizable and reducable components (the combination often referred to as redox couples). The oxidizable components of these compositions participate in color formation when the composition is exposed to radiation in one wavelength range while the reducable components participate in preventing color formation when the composition is exposed to radiation in another wavelength range. Frequently the wavelength ranges overlap so that care must be taken in selecting the oxidizable and reducable components to insure they each are sensitive to different activating radiations. Additionally, special filters must often be employed during each step in order to prevent premature activation of the other step.

U.S. Pat. No. 3,615,454 discloses another type of radiation sensitive composition. This composition comprises a leuco form of a dye, a photooxidant and a radiation-sensitive ethylenically-unsaturated polymerizable component. These compositions preferably employ an oxygen barrier that is transparent to the radiations used during the stabilization step.

The present invention provides novel compositions that do not require special selection of oxidizable and reducable components, or the use of special filters during color formation. Moreover the compositions of the present invention do not employ oxygen barriers.

Compositions of the present invention have a variety of uses. For example they are especially useful whenever substantially permanent images or color proofs are required such as in pattern making, printing, photography, etc. Additionally they may be used to provide positive or negative images merely by changing the order of exposure to the activating irradiations through one stencil thereby eliminating the need for preparing both positive and negative stencils.

SUMMARY OF THE INVENTION

In accordance with the present invention there is provided an improvement in imageable compositions of the type including (a) a dye in the leuco form, and (b) a hexaaromaticbiimidazole that, upon exposure to electromagnetic radiation at a wavelength of from about 250 to 400 nanometers, effects a conversion of said dye to a differently colored compound;

the improvement comprising;

including in said composition an oxygen sensitizing compound in an amount such that, upon exposure to electromagnetic radiation at a wavelength of from about 400 to 700 nanometers in the presence of oxygen, said dye is stabilized in the leuco form.

As it is used herein, the phrases "dye in the leuco-form" and "leuco form of the dye" mean the reduced form of a dye that is essentially colorless or, in some instances, is of a different color or of a less intense hue than the parent or oxidized form of the dye.

DETAILED DESCRIPTION OF THE INVENTION

Imageable compositions of the present invention may be conveniently prepared by dissolving a leuco form of dye, a hexaaromaticbiimidazole, and an oxygen sensitizing compound in an inert solvent. Other ingredients such as acid supplying compounds, plasticizers, binders, and fillers may also be added to the solution. Combinations of each of the ingredients may be employed if desired. Once prepared the solutions may be coated onto a substrate, such as a sheet material, under safelight conditions (e.g., the absence of activating radiations) and dried. The resultant imageable sheets may then be irradiated through a single stencil to produce positive or negative images. This may be accomplished by merely varying the order of exposure to activating irradiations. Color is produced when the imageable compositions are irradiated with electromagnetic radiation at a wavelength of from about 250 to 400 nanometers. The formation of color is prevented when the imageable compositions are irradiated with electromagnetic radiation at a wavelength of from about 400 to 700 nanometers. In this later step the leuco form of dye is stabilized in its leuco form such that subsequent exposure to color forming radiation (e.g., 250 to 400 nanometers) does not result in the leuco form of dye forming a differently colored compound.

During the color formation it is believed that the hexaaromaticbiimidazole is dissociated into its corresponding triaromaticimidazolyl radicals. It is further believed that these radicals oxidize the leuco form of the dye to a differently colored compound and in so doing are themselves reduced to triaromaticimidazoles that are inert to further participation in color formation. During the stabilization step it is believed that the oxygen sensitizing compound is activated to an excited energy state and that the excited sensitizer transfers energy to oxygen in the environment thereby forming singlet oxygen. The singlet oxygen is then believed to photooxygenate the hexaaromaticbiimidazole to supply products that will not oxidize the leuco form of the dye thereby stabilizing the dye in the leuco form and preventing the subsequent formation of color. Suprisingly the singlet oxygen is not materially affected by the leuco form of dye even though the leuco form is known to quench singlet oxygen and cause it to revert to its ground or unexcited state.

The imageable compositions of the invention may be exposed to activating irradiations in any order provided that the first irradiation be in an image-wise fashion, i.e., not a blanket or overall exposure.

The formation of color in the compositions of the invention occurs at a faster rate than does stabilization. Consequently special light filters are not necessary during color formation so long as the irradiation used contains substantial electromagnetic radiation of from about 250 to 400 nanometers. However, during stabilization it is preferable to employ optical filters in order to eliminate electromagnetic radiation below about 400 nanometers.

Suitable dyes in the leuco form for use in the compositions of the invention are those that are stable to oxidation under normal storage conditions yet are capable of being oxidized to a differently colored compound by the hexaaromaticbiimidazole during the color-forming reaction.

A large number of known dyes in the leuco form are useful in the present invention and include the following classes:

a. sulfoaminotriarylmethane salts, such as:

1-(2-sulfophenyl)-bis(4-diethylamino-2-tolyl)methane sodium salt;
1-(2-sulfophenyl)-bis(4-dimethylaminophenyl)methane sodium salt;
1-(4-sulfophenyl)-bis(4-dimethylaminophenyl)methane potassium salt;
1-(3-sulfophenyl)-bis(4-dimethylaminophenyl)methane sodium salt;
(2-sulfophenyl)(4-dimethylaminophenyl)(4-dimethylamino-2-sulfophenyl)methane disodium salt;
1-(4-sulfonapthyl)-bis(4-dimethylaminophenyl)methane sodium salt; etc.

b. aminotriarylmethanes, such as:

bis(4-dimethylamino-2-tolyl)(4-dimethylamino-2-chlorophenyl) methane;
bis(4-diethylamino-2-tolyl)(4-dimethylamine-2-chlorophenyl)methane;
tris(4-diethylamine-2-tolyl)methane; etc.

c. Aminoxanthenes, such as:

3,6-bis(methylamino)xanthene;
3,6-bis(methylamino)-9-(2-chlorophenyl)xanthene, etc.

d. aminothioxanthenes, such as:

3,6-bis(diethylamino)thioxanthene;
3,6-bis(dimethylamino)-9-(2-methoxycarbonyl)thioxanthene, etc.

e. amino-9,10-dihydroacridines, such as:

3-dimethylamino-9,10-dihydroacridine;
3,6-bis(dimethylamino)-9,10-dihydro-9-phenylacridine, etc.

f. aminophenoxazines, such as:

3,7-bis(diethylamino)phenoxazine;
3,7-bis[N-ethyl-N-(3-sulfobenzyl)amino]-phenoxazine, etc.

g. aminophenothiazines, such as:

3,7-bis(dimethylamino)phenothiazine;
3,7-bis(dimethylamino)-4-nitrophenothiazine, etc.

h. aminodihydrophenazines, such as:

3,7-bis(diethylamino)-5-cyclohexyl-5,10-dihydrophenazine, etc.

i. aminodiphenylmethanes, such as:

bis(4-diethylaminophenyl-N-methylaminomethane;
bis(4-diethylaminophenyl)(2,4-dichloroanilino)methane, etc.

j. leuco indamines, such as:

4-aminophenyl-4'-dimethylaminodiphenylamine;
4-(4-dimethylaminoanilino)phenol, etc.

k. aminohydrocinnamic acids (cyanoethanes, leuco methines):

4-amino-$\alpha,\beta$,-dicyano hydrocinnamic acid, methyl ester, etc.

l. hydrazines, such as:

1-(2-naphthyl)-2-phenylhydrazine, etc.

m. leuco indigoid dyes such as:

leuco indigo;
leuco 4,5,4',5'-tetrachloroindigo;
5,5'-dibromoindigo, etc.

n. amino-2,3-dihydroanthraquinones, such as:

1,4-diamino-2,3-dihydroanthraquinone;
1,4-dianilino-2,3-dihydroanthraquinone, etc.

o. tetrahalo-4,4'-bisphenols p. phenethylanilines, such as:

N-(2-cyanoethyl)-4-phenethylaniline;
N, N-diethyl-4-phenylethylaniline, etc.

The above-named leuco dyes have one or two removable hydrogens. Removal of these hydrogens, together with the removal of an additional electron in some cases, forms a differently colored compound. When these leuco forms of dye have only one removable hydrogen, and when the differently colored compound is cationic, then there is either, (a) at least one sulfo salt group present on the leuco that forms a zwitterion in the differently colored compound, or (b) a mineral acid, organic acid or acid-supplying compound added to the imageable composition that forms a salt with the leuco form of dye. If a mineral acid, organic, or acid-supplying compound is added to compositions of the invention it is present in the range of from about 0.5 to 1, and preferably from about 0.7 to 0.9, equivalents of acid per equivalent of lueco form of dye.

Other examples of leuco dyes of the type designated above as classes (b) through (p) are described and exemplified in U.S. Pat. No. 3,445,234 which is incorporated herein by reference.

Still other compounds useful as the leuco form of dye include:

q. 10-acylaminophenothiazines; 10-acylaminophenoxazines; and 10 acylaminodihydrophenazines such as:

10-acetyl-3-diethylamino-7-dimethylaminophenothiazine;
10-acetyl-3,7-bis(dimethylamino)phenoxazine; and
10-benzoyl-3,7-bis(dimethylamino)-5,10-dihydro-5-methylphenazine; etc., described and further exemplified in U.S. Pat. No. 3,395,018 which is incorporated herein by reference.

r. oxoarylideneimidazoles such as:

2-(4-hydroxyphenyl)-4,5-diphenylimidazole;
2-(3,5-di-t-4-hydroxyphenyl)-4-(dimethylaminophenyl)-5-phenylimidazole, etc., described and further exemplified in U.S. Pat. No. 3,297,710 which is incorporated herein by reference.

s. N-hydrocarbyl substituted dihydroheterocyclic amines such as:

2-(4-dimethylaminostyryl)-1,3',3-trimethylindoline, etc., described and further exemplified in assignee's copending application Ser. No. 347,193, filed Apr. 2, 1973, which is incorporated herein by reference.

The most preferred leuco form of the dyes are the sulfoaminotriarylmethane salts. Although it has been found that the sulfo salt group may be oriented ortho, meta or para to the methane carbon atom of these leuco dyes, it is preferred that it be in the ortho position. A preferred sulfoaminotriarylmethane salt is 1-(2-sulfophenyl)-bis(4-diethylamine-2-tolyl)methane sodium salt. The sulfoaminotriarylmethane salts may be prepared according to the procedures described in Vol. II, Chemistry of Synthetic Dyes, K. Venkataraman, Academic Press Inc. (1952), page 705+ (especially page 712).

The leuco form of the dye comprises from about 15 to 90, and preferably from about 40 to 60, percent by weight of the combined weight of the leuco form the dye plus hexaaromaticbiimidazole in the final composition. Correspondingly the hexaaromaticbiimidazole comprises from about 85 to 10, and preferably from about 60 to 40, percent by weight of the combined weight.

Suitable hexaaromaticbiimidazoles for use in the compositions of the invention are known compounds and are photodissociable into their corresponding triaromaticimidazolyl radicals when exposed to electromagnetic radiation having a wavelength of from about 250 to 400 nanometers. The aromatic groups of the biimidazoles may be the same or different carbocyclic or heterocyclic groups and may be substituted or unsubstituted. When the aromatic groups are substituted the substituents must not prevent either the dissociation of the biimidazole into the corresponding imidazolyl radicals or the oxidation of the leuco form of the dye to a differently colored compound.

The hexaaromaticbiimidazoles may be symmetric or asymmetric and may be represented respectively by the formulae:

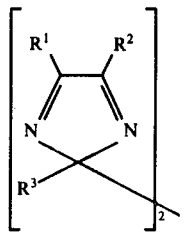
(I)

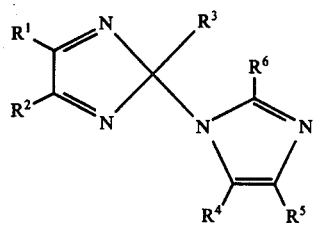
(II)

where $R^1$ to $R^6$ are the same or different and are selected from one and two ring aromatic carbocyclic and heterocyclic groups containing carbon, nitrogen, sulfur or oxygen, each of the groups containing from 5 to 14 atoms. Representative examples of suitable aromatic groups are phenyl, napthyl, pyridyl, quinolyl, furyl, benzofuryl, thienyl and benzothienyl.

Suitable non-interferring substituents on the aromatic groups have a Hammett sigma (para) value of from about −0.5 to 0.8 and are other than hydroxy, sulfhydryl, amino, alkyl amino, and dialkyl amino. Preferably the substituents have no hydrogen atoms reactive toward methyl magnesium iodine.

Thus the substituents may be halogen, cyano, lower hydrocarbonyl (including alkyl, haloalkyl, cyanoalkyl and aryl), alkoxy, aryloxy, alkylthio, arylthio, sulfo, alkylsulphonyl, arylsulphonyl and nitro. The alkyl groups referred to in the above list preferably contain 1 to 6 carbon atoms, while the aryl groups referred to preferably contain 6 to 10 carbon atoms.

Representative substituents and their Hammett sigma (para) values (sometimes referred to hereinafter as H), relative to H=0.00, as given by Jaffe, Chem. Rev. 53, 219–233 (1953) are: methyl (−0.17), ethyl (−0.15), t-butyl (−0.20), phenyl (0.01), butoxy (−0.32), phenoxy (−0.03), fluoro (0.06), chloro (0.23), bromo (0.23), iodo (0.28), methylthio (−0.05), nitro (0.78), ethoxycarbonyl (0.52), and cyano (0.63). Although these substituents are preferred, other substituents which may be employed include trifluoromethyl (0.55), chloromethyl (0.18), carboxyl (0.27), cyanomethyl (0.01), 2-carboxyethyl (−0.07), and methylsulfonyl (0.73).

Preferably the aryl radicals are carboxyclic, particularly phenyl, and the substituents have Hammett sigma values in the range of from about −0.4 to +0.4, particularly lower alkyl containing from 1 to 4 carbon atoms, lower alkoxy containing from 1 to 4 carbon atoms, chloro, fluoro, bromo and benzo groups.

Representative examples of useful formula I type hexaarylbiimidazoles are:

2,2'-bis(2-chlorophenyl)-4,4',5,5'-tetrakis(4-methoxyphenyl)biimidazole;
2,2'-bis(2-chlorophenyl)-4,4',5,5'-tetraphenylbiimidazole;
2,2'-bis(2-tolyl)-4,4',5,5'-tetraphenylbiimidazole;

2,2'-bis(2-methoxyphenyl)-4,4',5,5'-tetraphenylbiimidazole;
2,2'-diphenyl-4,4',5,5'-tetrakis(4-methoxyphenyl)-biimidazole;
2,2',4,4',5,5'-hexaphenylbiimidazole;
2,2'-bis(2-furyl)-4,4',5,5'-tetraphenylbiimidazole;
2,2'-bis[5-(2-methylfuryl)]-4,4',5,5'-tetraphenylbiimidazole;
2,2'-bis(2-thienyl)-4,4',5,5'-tetraphenylbiimidazole;
2,2'-bis[2-(1-methylpyrrolyl)]-4,4',5,5'-tetraphenylbiimidazole; and
2,2'-bis(1-naphthyl)-4,4',5,5'-tetraphenylbiimidazole.

These and other specific examples of useful formula I type hexaaromaticbiimidazoles are described in U.S. Pat. Nos. 3,445,234; 3,666,466; and 3,647,467 which are incorporated herein by reference.

Representative examples of useful formula II type hexaaromaticbiimidazoles are:

2-phenyl-2'-(2-chlorophenyl)-4,4',5,5'-tetraphenylbiimidazole;
2-phenyl-2'-(2-tolyl)-4,4',5,5'-tetraphenylbiimidazole; and
2-phenyl-2'-(2-methoxyphenyl)-4,4',5,5'-tetraphenylbiimidazole.

This type of hexaaromaticbiimidazole may be prepared in a manner similar to that used in preparing the formula I type of hexaaromaticbiimidazoles except that at least two different triaromaticimidazoles rather than a single triaromaticimidazole is used.

Asymmetric hexaaromaticbiimidazoles are preferred in compositions of the present invention. It has been found that the compositions containing these biimidazoles not only produce good color in imaged areas during color formation, they also provide better resistance to background coloration during the stabilization step as compared to compositions of the invention containing symmetric hexaaromaticbiimidazoles. A preferred asymmetric hexaaromaticbiimidazole is 2-phenyl-2'-(2-tolyl)-4,4',5,5'-tetraphenylbiimidazole. A preferred symmetric hexaaromaticbiimidazole is 2,2'-bis(2-tolyl)-4,4',5,5'-tetraphenylbiimidazole.

Suitable oxygen sensitizing compounds for use in the present invention are polycyclic aromatic compounds that may be carbocyclic or heterocyclic, the cyclic portion containing carbon, nitrogen, sulfur or oxygen. They are capable of bringing about the formation of singlet oxygen when exposed to electromagnetic radiation having wavelengths of from about 400 to 700 nanometers in the presence of oxygen.

A variety of classes of compounds, known per se, are useful as oxygen sensitizers. One such class consists of the substituted and unsubstituted porphyrins. These compounds have four pyrrole nuclei linked together in a circular pattern by four atoms so that a large 16 membered ring is formed. The position of the connecting atoms may be designated as the meso positions or as $\alpha$, $\beta$, $\gamma$ and $\delta$ positions. Thus the porphyrins may be represented by the formula

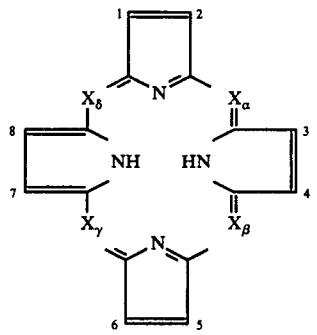

(III)

wherein X is selected from carbon and nitrogen, wherein the carbon may have attached thereto hydrogen, alkyl containing from about 1 to 14 carbon atoms, aryl groups, and heterocyclic groups containing carbon, oxygen, nitrogen or sulfur. Additionally the porphyrins can have substituents at other positions, especially the numbered positions.

Representative examples of aryl groups that can be attached to the carbon atom include phenyl, chlorophenyl, dichlorophenyl, methylphenyl, N,N-dimethylaminophenyl, $\alpha$-napthyl, $\beta$-napthyl, anthracyl, phenanthryl, etc.

Representative examples of heterocyclic groups that can be attached to the carbon atom include furyl, thienyl, pyridyl, thiazolyl, diazolyl, triazolyl, pyrryl, quinolyl, oxazolyl, oxadiazolyl, pyrazolyl, indolyl, benzothienyl, benzofuryl, benzoxazolyl, benzoisoxazolyl, benzothiazolyl, benzimidazolyl, etc.

Representative examples of substituents that can be utilized at other positions, especially the numbered positions, include alkyl, vinyl, propionic acid groups, aryl groups, benzo groups fused to adjacent numbered positions on the pyrrole ring, organic residues completing a benzo group between adjacent numbered groups, etc.

Metal chelate forms of the above described porphyrins are also useful in the present invention. They can be represented by the above porphyrin structure with the following bonding between the metal (M) and the pyrrole nitrogens.

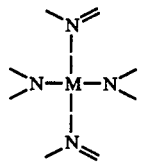

Metals suitable for chelation include zinc, magnesium, copper, iron, nickel, cobalt, lead, sodium, potassium, calcium, etc. Thus whenever the porphyrins are described or claimed herein, it is intended that the chelated forms also be included.

Representative examples of useful porphyrins include:

$\alpha$, $\beta$, $\gamma$, $\delta$-tetraphenylporphyrin;
hematoporphyrin;
$\alpha$, $\beta$, $\gamma$, $\delta$-tetrakis(2,4-dichlorophenyl)porphyrin;
$\alpha$, $\beta$, $\gamma$, $\delta$-tetraphenylporphyrin zinc complex;
tetrabenzodiazaporphyrin;
tetrabenzomonoazaporphyrin;

phthalocyanine;
magnesium phthalocyanine;
chlorophyl-A;
sodium-copper chlorophyllin;
octakis(2,3-dichlorophenyl)porphyrazine;
octaphenyldiazaporphyrin;
magnesium octaphenyltetrazaporphyrin octaphenyl-α, β, γ, δ-tetramethylporphyrin;
tetrabenzoporphyrin;
α, β, γ, δ-tetraphenyltetrabenzoporphyrin;
dibenzo-meso-diphenylporphyrin;
tetrakis(3,4-dichlorobenzo)-α, β, γ, δ-tetrakis(2,3-dichlorophenyl)porphyrin;
1,5-dimethyl-α, β, γ, δ-tetrakis(2-thienyl) porphyrin;
α, β, γ, δ-tetrakis(4-pyridyl)porphyrin; and
1,3,5,8-tetraisopropyl-α, β, γ, δ-tetraindolylporphyrin.

Other specific examples of porphyrins of the type described may be found in U.S. Pat. Nos. 2,950,237; 2,951,797, 2,951,798; 2,951,799; and 2,951,800 which are incorporated herein by reference.

Another useful class of oxygen sensitizers consists of the polycyclic aromatic compounds comprising at least two moieties in conjugate relationship as a part of a single chromophore, each of the moieties comprising three linearly kata condensed, 6-membered aromatic rings, and an -OZ group attached to the meso position of each of the moieties, wherein Z is a stable monovalent radical. The above-described moieties have the formulae

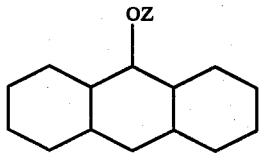

(IV)

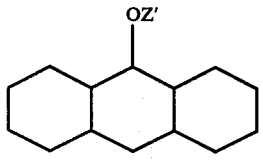

(V)

The aromatic rings may be carbocyclic or heterocyclic, the hetero atoms being generally nitrogen. Of course, a single compound can contain both carbocyclic and heterocyclic moieties of the type just described, or the compound may contain only carbocyclic or only heterocyclic moities.

These moieties, in conjugate relationship in the compound, may be bonded together in peri fashion such that the two moieties share atoms, or they may be attached to each other in conjugate relationship to at least one linking moiety where the linking moiety is selected from the group consisting of (a) atoms which are at least trivalent and are capable of forming covalent bonds, (b) ligands, having two or more atoms, which are at least bidentate, and (c) covalent single or double bonds.

The size, chemical nature or structure of the linking moiety is not critical insofar as the general ability of the dye compound to function as an oxygen sensitizer is concerned, so long as the two moieties comprising the kata condensed aromatic rings are attached to each other in conjugate relationship such that they are part of a single chromophore.

The linking moiety, of course, can be a polycyclic structure (carbocyclic or heterocyclic). Hetero atoms in the heterocyclic linking moieties are generally nitrogen, oxygen and sulfur.

In many of the compounds there are two linking moieties. For example, there may be two ligands, one ligand and a covalent bond, two covalent bonds, etc., as linking moieties in a single compound.

Although the —OZ and —OZ' groups which are present on the dye compounds are also auxochromic groups, it has been found that they are primarily solubilizing for the compound, i.e. they primarily determine the solubility of the dye compound in various solvent media into which the dye may be placed. It has also been found that the Z and Z' radicals have very little effect on the ability of the compound to function as an oxygen sensitizer. Thus the chemical structure and nature of the Z and Z' radicals is not critical.

Generally, it may be said that Z and Z' are monovalent radicals which are stable under ambient conditions and which do not cause decomposition of the chromophore portion of the dye compound. That is, these radicals do not oxidize or reduce the chromophore portion of the dye compound nor do they destroy or adversely affect the effectiveness of the compound as a dye. Within these limitations the —OZ and —OZ' radicals can be stable derivatives of an inorganic acid, e.g. $—O-SO_3^-Y^+$ where Y is an alkaline metal, alkaline earth metal, or ammonium anion; $—OPO_3R_7^2$ and $—OPO_2R^7_2$ where $R^7$ is hydrogen or a stable organic radical.

Insofar as organic radicals are concerned, Z and Z' may be alkyl, cycloalkyl, substituted alkyl and cycloalkyl, alkenyl, alkynyl, aryl, polycyclic, acyl, alkaryl or aralkyl. Z and Z' may be the same or different. Alkyl radicals having one carbon or more are common Z radicals, and lower alkyl radicals (e.g., 1 to 4 carbon atoms) are preferred, although long chain alkyls are also useful. Substituted alkyl radicals useful in this type of oxygen sensitizer are herein defined to include alkyl radicals which are substituted with any moiety or group other than hydrogen atoms and other alkyl radicals.

The auxochromic groups which are bonded to the chromophore portion of the dye compound may consist of one atom or of many atoms. Preferably a heavy atom, i.e., having an atomic weight of at least 31, is present as part of the auxochromic group and is bonded directly to the chromophore portion of the dye. Most preferably there are at least two heavy atoms bonded to the chromophore, the heavy atoms being a halogen selected from bromine and chlorine. They may be bonded either to the linking moieties or to the moieties comprising the kata condensed aromatic rings. An auxochromic group may be defined as a group bonded to a chromophore which influences the nature of the excited states, as defined in Theory and Application of Ultraviolet Spectroscopy, Jaffe and Orchin, John Wiley & Sons, Inc. (1962).

Preferred single atom auxochromic groups include chlorine, bromine, mercury, sulfur, iodine and selenium. Other useful single atom auxochromic groups include phosphorus (treated herein as having an atomic weight of 31), arsenic, tellurium, germanium, tin, lead and antimony. The auxochromic group may consist of more than one atom so long as a heavy atom present as part of the auxochromic group is directly bonded to the chromophore portion of the dye. For example,

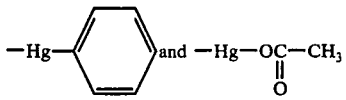

are useful auxochromic groups.

The above-described auxochromic groups may be bonded directly to one or both of the moieties comprising the kata condensed aromatic rings, or the auxochromic groups may be bonded to the linking moiety instead, so long as the auxochromic groups are bonded to the chromophore portion of the compound. So far as is known, the particular positions of attachment of the auxochromic groups to the chromophore do not influence the ability of the dye compound to function as an oxygen sensitizer.

In addition to the —OZ and —OZ′ solubilizing groups and the auxochromic groups, the above classes of dye compounds may also be substituted with various other groups (e.g., fluorine, nitrile, hydroxy, alkyl, aryl, polycyclics, acyl, alkoxy) which are stable and do not cause decomposition of the chromophore portion of the dye compound.

Representative examples of oxygen sensitizing compounds of this latter class include the alkylated vat dyes such as ethylated Vat Blue 18 (C.I. 59815) ethylated Vat Orange 2 (CI 59705), ethylated Vat Green 1 (CI 59825), methylated Vat Blue 26 (CI 60015), ethylated Vat Yellow 4 (CI 59100), ethylated Vat Violet 1, (CI 60010), butylated Vat Yellow 1 (CI 70600), etc. Other examples of these compounds and a method for their preparation may be found in U.S. Pat. No. 3,799,779.

Other useful classes of oxygen sensitizers include the xanthenes such as fluoroscein, tetrachlorofluorescein, erythrosine, eosine, tetrachloroeosine, Rose Bengal (CI 45440), Rhodamine B (CI 45170), etc.; thiazines such as thionine, methylene blue (CI 52015), etc.; azines such as phenosafranin (CI 50200); Safranin T (CI 50240), etc.; flavins such as proflavin, lumiflavin, thioflavin, riboflavin, riboflavin-5′-phosphate, etc.; and oxazines such as resazurin.

Representative examples of still other useful oxygen sensitizers include 9,10-diphenylanthracene; 5,6,11,12-tetraphenylnapthacene; pyrene; 3,4-benzopyrene; triphenylene; perylene; 1,8-dinapthalenethiophene; 9-anthraldehyde; and 10-chloro-9-anthraldehyde. Polymeric based compounds such as Rose Bengal attached to chloromethylated polystyrene and eosine attached to a basic anion exchange resin are also useful as oxygen sensitizers.

The preferred oxygen sensitizers are the porphyrins and the compounds comprising at least two moieties in conjugate relationship as a part of a single chromophore having at least two halogens selected from bromine and chlorine bonded to the chromophore. The preferred oxygen sensitizers of the former type are the tetraarylporphyrins (i.e., $\alpha,\beta,\gamma,\delta$ tetraphenylporphyrin) and the octaaryltetraazaporphyrins (i.e., octaphenyltetraazaporphyrin). The preferred oxygen sensitizers of the latter type are the ethylated Vat dyes, especially ethylated Vat Blue 18 (CI 59815) which is also known as ethylated trichloroviolanthrone. The oxygen sensitizers comprise from about 0.25 to 5 percent by weight of the combined weight of the leuco form of the dye plus hexaaromaticbiimidazole although more or less may also be used. Preferably the oxygen sensitizers comprise from about 0.5 to 3 percent by weight of the combined weight.

Not all of the compounds that come within the foregoing description of oxygen sensitizers are useful in the practice of the present invention. Thus a suitable test has been found to conveniently distinguish the useful oxygen sensitizers from those which are not useful in this invention.

A particular sensitizer to be tested (0.125 grams) is dissolved in one liter of acetone. One hundredth mole (0.01 mole) of 1,3-diphenylisobenzofuran is then dissolved in the dye solution. Light from two 150 watt flood lamps, focused by two round bottom flasks filled with water, is used to photolyze the solution. Air, scrubbed with acetone, is bubbled in to provide the solution with oxygen. The entire solution is rapidly stirred with a magnetic stirrer. The total photolyzing time is about 1½ hours, during which time oxygen sensitizers useful in the present invention cause the 1,3-diphenylisobenzofuran to disappear linearly and smoothly with a zero order rate plot viz., such oxygen sensitizers may be said to have a suitable "linear photolysis characteristic". The concentration of 1,3-diphenylisobenzofuran as well as sensitizer is followed by U.V.-visible spectroscopy. The concentration of the sensitizer does not change throughout the course of the reaction. When the light from the flood lamps is turned off or when the solution is photolyzed in the absence of oxygen the concentration of the 1,3-diphenylisobenzofuran no longer decreases. When the solution is photolyzed in the absence of sensitizer but in the presence of oxygen the rate of 1,3-diphenylisobenzofuran disappearance is extremely slow.

The present invention provides positive or negative images by either varying the order of exposure to the activating irradiations through one stencil or by separately irradiating through positive and negative stencils. The image contrast obtained after exposure, i.e., the contrast between the colored and non-colored areas of the compositions, is dependent upon (i) the intensity and duration of the irradiating source, and (ii) the distance from the source to the imageable compositions. Thus, for a given composition, the image contrast may be varied to suit ones needs.

A variety of radiation sources may be employed during color formation and stabilization. Suitable sources include mercury lamps, carbon arc lamps, pulsed xenon lamps, etc. Other useful light sources are known to those in the art.

Other ingredients may be added to the compositions of the present invention. They include binders, plasticizers, and inert fillers.

Binders are preferably employed in order to hold the imageable compositions in position. Suitable binders are film-forming, oxygen-permeable and transmissive to the electromagnetic radiation used in effecting both the conversion of the leuco dye to a differently colored compound and the stabilization of the leuco dye in the leuco form. They may comprise up to 10 times or more by weight of the combined weight of the leuco form of dye and the hexaaromaticbiimidazole. Representative examples of classes of useful binders include styrene/-butadiene rubbers, silicone rubbers, ethylene/proplyene rubbers, cellulosic ethers and cellulosic esters, etc. A preferred class of binders comprises the cellulosic ethers such as "Ethocel" (N- or T- grades) commercially available from Hercules.

Suitable plasticizers improve the flexibility of films and coatings of the imageable composition thereby facilitating both color formation and stabilization. The plasticizers may comprise up to ten times or more of the combined weight of the leuco form of dye and the hexaaromaticbiimidazole.

Representative examples of useful plasticizers include phosphate esters such as tricresylphosphate, methyldiphenylphosphate; phthalate esters such as dibutylphthalate, diphenylphthalate, di(ethylcellosolve)phthalate; amides such as p-toluenesulfonamide, diethyldiphenylurea, bis-(dibutyl)adipamide; mineral oils such as "Nujol" (a mixture of heavy liguid petroleum hydrocarbons commercially available from Plough, Inc.); fatty acids such as oleic and stearic acids; fatty alcohols such as cetyl and stearyl alcohols; vegetable oils such as castor oil, corn oil, cottonseed oil; polyethyleneglycols and their derivatives such as the "Carbowaxes" (commercially available from Union Carbide); phenoxypolyoxyethyleneethanols such as "Igepal" (commercially available from GAF) and "Triton" X-100 (commercially available from Monsanto); miscellaneous esters such as methylabietate, butylstearate, and dihexyladipate; and combinations thereof.

Inert, infusible fillers that may be employed in the present invention include titanium dioxide, collodial silica, powdered glass, clays such as bentonite, glass beads, glass bubbles, etc. Fillers are added to provide opacity to compositions and sheets of the present invention. They also improve pencil and ink receptivity.

The compositions of the present invention may be conveniently prepared by dissolving the ingredients in an inert solvent in a suitable vessel at ambient temperature and pressure under safe-light conditions. The solution may then be applied to a suitable substrate by a variety of techniques (e.g., spraying, dipping, brushing, roll coating), and dried. Alternatively the compositions of the invention may be provided as self-supporting films by applying a layer of a solution thereof to a release-type of substrate, drying the coated layer and removing the resultant dried film therefrom.

The thickness of the dried coatings and films is not critical to the present invention. However, they should be thick enough to provide a discernable image yet not so thick as to prevent excited oxygen from permeating the dried layer. It has been found that coatings and films of from about 10 to 50 microns thick give satisfactory results.

Solvents useful in preparing compositions of the present invention include alcohols such as methanol, butanol, etc.; ketones such as acetone, methylethylketone, etc.; esters such as ethyl and amyl acetate, etc.; aromatic hydrocarbons such as benzene, toluene, etc.; aliphatic halocarbons such as methylene chloride, 1,1,2-trichloroethane; and mixtures thereof.

When cellulosic ethers are employed as binders in the compositions of the invention, it is preferred that the major constituents of the solvent system be selected from acetone, methyl ethyl ketone, methanol, ethanol or combinations thereof. In this instance minor amounts (e.g. less than 10 percent by weight) of other solvents may be included.

A wide variety of substrates may be coated with compositions of the present invention including paper (e.g. photographic paper), polyester (e.g., polyethyleneterephthalate), metals (e.g. aluminum, copper), and glass.

The following examples are meant to further illustrate the present invention without limiting it. All parts given are parts by weight unless otherwise noted.

EXAMPLE 1

An imageable composition was prepared by dissolving 50 parts by weight of the leuco form of a dye [bis(4-dimethylamino-2-tolyl)(4-dimethylamino-2-chlorophenyl)methane], 50 parts by weight of hexaarylbiimidazole [2,2',4,4',5,5'-hexaphenylbiimidazole], 2.5 parts by weight oxygen sensitizer [ethylated Vat Blue 18 (C.I. 59815)], 25 parts by weight acid supplier [p-toluenesulfonic acid], 750 parts by weight of plasticizer [N-ethyl-4-toluenesulfonamide], and 300 parts by weight of binder ["Ethylcellulose" N-200] in 14470 parts by weight of solvent (95% acetone and 5% n-butanol by weight). Dissolution was carried out under safelight conditions at atmospheric pressure and 25° C and required about 60 minutes.

The composition was knife coated onto photographic paper under safelight conditions to a wet thickness of about 200 microns and the coated paper was dried at 25° C for 2 hours in a dark room to a thickness of 8 microns. The negative mode of the resulting imageable sheet was illustrated by exposing the sheet through a stencil to electromagnetic radiation in the wavelength range of about 250 to 400 nanometers for one minute using a 750 watt H3T7 mercury lamp (commercially available from General Electric). The sheet was located 17 centimeters from the lamp. The imaged areas turned dark blue while the nonimage areas were pink. The sheet was fixed against further color formation by blanket exposure to a tungsten halide lamp (Sylvania 78-8454-3463-4-F) through a Corning Glass filter (CS 3-71) for 2 minutes.

The positive mode of the imageable sheet was demonstrated by exposing a fresh sample of the sheet to radiation having a wavelength greater than 400 nanometers through a stencil for two minutes using a tungsten halide lamp (Sylvania 78-8454-3463-4-F) and a CS3-71 light filter (commercially available from Corning Glass Works) to eliminate substantially all of the radiation below 400 nanometers. The sheet was located 15 cm from the lamp. The sheet was then given a blanket exposure for one minute to electromagnetic radiation in the 250–400 nanometer wavelength range from a 750 watt H3T7 mercury lamp. During the second exposure color developed only in the non-imaged areas.

The image contrast between colored and stabilized areas of the compositions of the invention was demonstrated by means of the test described in the *SPSE Handbook of Photographic Science and Engineering,* Interscience Publishers (1973) at pages 829–877. The test was carried out using a "MacBeth Quantalog Densiometer", model RD-100 commercially available from MacBeth Instrument Co., Newburgh, New York and a neutral density filter (Model Wratten #106W commercially available from Eastman Kodak). The test measured the densiometry or color density of the imaged sheets by measuring the amount of light reflected from the colored and stabilized portions thereof. The maximum densiometry represented the color density of the colored areas while the minimum densiometry represented the color density of the stabilized areas. The difference between the maximum and the minimum densiometry readings represented the image contrast. Larger differences indicated sharper contrasts. A difference of greater than 0.4 was assigned a value of A, while the difference of from 0.2–0.4 was assigned a value of B and a difference of less than 0.2 was assigned a value of C.

When tested for image contrast according to this test, both the positive and negative modes had an image contrast of A.

EXAMPLE 2

An imageable composition was prepared according to the procedures described in Example 1 having the formula

| | Parts by Weight |
|---|---|
| Leuco form of dye 1-(2-sulfophenyl)-bis (4-diethylamino-2-tolyl) methane sodium salt. | 50 |
| Hexaaromaticbiimidazole 2,2'-Bis(2-tolyl)-4,4',5,5'-tetraphenylbiimidazole | 50 |
| Oxygen sensitizer α,β,γ,δ-Tetraphenylporphyrin | 1.25 |
| Plasticizer N-ethyl-4-toluenesulfonamide | 250 |
| Binder "Ethylcellulose" N-200 | 375 |
| Solvent n-Butanol | 362 |
| Acetone | 6888 |

The composition was knife coated onto polyester film and onto photographic paper to a wet thickness of about 200 microns and then dried at 25° C for 2 hours in a dark room. The negative mode of the resulting imageable sheets was illustrated by exposing them through a silver halide negative placed on top of the sheets to electromagnetic radiation in the wavelength range of about 250 to 400 nanometers for one minute using a 750 watt H3T7 mercury lamp. The sheet was located 17 centimeters from the lamp. The imaged areas turned green while the non-imaged areas were essentially colorless. The sheet was fixed against further color formation as in Example 1 by blanket exposure to radiation having a wavelength greater than 420 nanometers using a tungsten-halide lamp commercially available from Sylvania as 78-8454-3463-4-F. The positive mode of the imageable sheets was demonstrated as described in Example 1. The imageable sheet having the polyester substrate had an image contrast rating of B in the negative mode and C in the positive mode. The imageable sheet having the photographic paper substrate had an image contrast rating of A in both the positive and the negative modes.

EXAMPLES 3–6

Imageable compositions were prepared and coated onto photographic paper and their negative and positive modes illustrated and tested for image contrast, as described in Example 1. The ingredients and amounts used in parts by weight and the image contrast ratings are given in Table 1.

Table 1

| Example | 3 | 4 | 5 | 6 |
|---|---|---|---|---|
| Lueco form of dye: Bis (4-diethylamino-2-tolyl) (4-diethylamino-2-chlorophenyl)methane | 80 | 50 | 28.5 | 16.5 |
| Hexaaromaticbiidazole: 2,2'-Bis(2-tolyl)-4,4',5,5'-tetraphenylbiimidazole | 20 | 50 | 71.5 | 83.5 |
| Oxygen Sensitizer: Ethylated Vat Blue 18 (CI 59815) | 4 | 2.5 | 1.4 | 0.55 |
| Acid Supplier: Toluenesulfonic acid | 40 | 25 | 14.3 | 8.3 |

Table 1-continued

| Example | 3 | 4 | 5 | 6 |
|---|---|---|---|---|
| Plasticizer: N-ethyl-4-toluenesulfonamide | 1200 | 750 | 430 | 167 |
| Binder: "Ethylcellulose"-N-200 | 1000 | 625 | 360 | 140 |
| Solvent: (95/5 Acetone/n-butanol) | 18950 | 11845 | 6790 | 2630 |
| Image Contrast: | | | | |
| Negative Mode | B | A | A | A |
| Positive Mode | B | B | B | B |

EXAMPLES 7–9

Examples 3–5 were repeated except that the leuco form of the dye used was 2-(3,5-di-t-butyl-4-hydroxyphenyl)-4-(dimethylaminophenyl)-5-phenylimidazole and no acid supplier was used. The image contrast ratings obtained are given in Table 2.

Table 2

| Example | 7 | 8 | 9 |
|---|---|---|---|
| Image Contrast | | | |
| Negative Mode | A | A | A |
| Positive Mode | B | B | B |

EXAMPLES 10–25

Example 1 was repeated substituting various oxygen sensitizers for ethylated Vat Blue 18 (CI 59815). The sensitizers used and the image contrast ratings obtained are given in Table 3.

Table 3

| Example | Oxygen Sensitizer | Image Contrast Negative Mode | Image Contrast Positive Mode |
|---|---|---|---|
| 10 | Magnesium phthalocyanine | A | A |
| 11 | Hematoporphyrin | C | B |
| 12 | Tetrachlorofluorescein | C | C |
| 13 | Erythrosin | C | B |
| 14 | Thionin | B | C |
| 15 | Safranine T | B | B |
| 16 | Phenosafranine | A | A |
| 17 | Riboflavin-5-phosphate | B | B |
| 18 | Lumiflavin | C | A |
| 19 | Resazurin | A | A |
| 20 | Ethylated Vat Orange 2 (CI 59705) | A | A |
| 21 | Butylated Vat Yellow 1 (CI 70600) | B | B |
| 22 | 1,8-dinaphthylenethiophene | A | A |
| 23 | 3,4-benzopyrene | C | B |
| 24 | Anthraldehyde | B | B |
| 25 | 1,8-dihydroxyanthraquinone | C | B |

EXAMPLES 26–35

Example 1 was repeated substituting various hexaarylbiimidazoles for 2,2',4,4',5,5'-hexaphenylbiimidiazole. The biimidazoles used and the image contrast ratings obtained in the negative mode are given in Table 4.

Table 4

| Example | Hexaaromaticbiimidazole | Image Contrast |
|---|---|---|
| 27 | 2,2'-bis(2-chlorophenyl)-4,4',5,5'-tetrakis(4-methoxyphenyl)biimidazole | A |
| 28 | 2,2'-bis(2-chlorophenyl)-4,4',5,5'-tetraphenylbiimidazole | A |
| 29 | 2,2'-bis(2-tolyl)-4,4',5,5'-tetraphenylbiimadazole | A |
| 30 | 2,2'-bis(2-methoxyphenyl)-4,4',5,5'-tetraphenylbiimidazole | C |
| 31 | 2,2'-diphenyl-4,4',5,5'-tetrakis-(4-methoxyphenyl)biimidazole | B |
| 32 | 2,2'-bis(2-furyl)-4,4',5,5'-tetraphenylbiimidazole | B |

Table 4-continued

| Example | Hexaaromaticbiimidazole | Image Contrast |
|---|---|---|
| 33 | 2,2'-bis[5-(2-methylfuryl)]-4,4',5,5'-tetraphenylbiimidazole | C |
| 34 | 2,2'-bis(2-thienyl)-4,4',5,5'-tetraphenylbiimidazole | C |
| 35 | 2,2'-bis[2-(1-methylpyrrolyl)]-4,4',-5,5'-tetraphenylbiimidazole | C |
| 36 | 2-phenyl-2'-(2-tolyl)-4,4',5,5'-tetraphenylbiimidazole | A |

What is claimed is:

1. In an imageable composition of the type including (a) a dye in the leuco form, and (b) a hexaaromaticbiimidazole that, upon exposure to electromagnetic radiation at a wavelength of from about 250 to 400 nanometers, effects a conversion of said dye to a differently colored compound;

the improvement comprising:

including in said composition an oxygen-sensitizing compound which, when exposed to radiation of from 400 to 700 nanometers in the presence of oxygen, brings about the formation of singlet oxygen and exhibits a linear photolysis characteristic wherein said sensitizing compound causes 1,3-diphenylisobenzofuran to disappear linearly and smoothly with a zero order rate plot when a solution comprising 0.125 grams of said oxygen sensitizing compound, 0.01 mole of 1,3-diphenylisobenzofuran and 1 liter of acetone is irradiated with light from two 150 watt flood lamps focused on said solution; wherein said oxygen sensitizing compound is selected from the group consisting of porphyrins, and polycyclic aromatic compounds comprising from 2 to 3 moieties in conjugate relationship as a part of a single chromophore, each of said moieties comprising three linearly kata condensed, 6-membered carbocycles, an —OZ group being attached to the meso position on each of said moieties, wherein Z is a stable monovalent radical, the —OZ group being a stabilizing group for said polycyclic aromatic compound, wherein at least one auxochromic group comprising an atom having an atomic weight of at least 31 is bonded to said chromophore by means of the atom and wherein said moieties are joined together by means selected from bonding said moieties in the peri fashion and bonding said moieties through a linking moiety selected from the group consisting of (a) atoms which are at least trivalent and are capable of forming covalent bonds, (b) ligands having two or more atoms which are at least bidentate, and (c) covalent single and double bonds;

wherein said oxygen sensitizer is present in an amount such that, upon exposure of said composition to electromagnetic radiation at a wavelength of about 400 to 700 nanometers in the presence of oxygen, said dye is stabilized in the leuco form.

2. An imageable composition according to claim 1 wherein said leuco form of dye is selected from the group consisting of sulfoaminotriarylmethane salts; aminotriarylmethanes; aminoxanthenes; aminothioxanthanes; amino-9,10-dihydroacridines; aminophenoxazines; aminophenothiazines; aminodihydrophenazines; aminodiphenylmethanes; leuco indamines; aminohydrocinnamic acids; hydrazines; leuco indigoid dyes; amino-2,3-dihydroanthraquinones; tetrahalo-4,4'-bisphenols; phenethylanilines; 10-acylaminophenothiazines; 10-acylaminophenoxazines; 10-acylaminodihydrophenazines; oxoarylideneimidazoles; and N-hydrocarbyl substituted dihydroheterocyclic amines.

3. An imageable composition according to claim 2 wherein said dye in the leuco form comprises an aminotriarylmethane.

4. An imageable composition according to claim 3 wherein said aminotriarylmethane is tris(4-diethylamino-2-tolyl)methane.

5. An imageable composition according to claim 2 wherein said dye in the leuco form comprises a sulfo aminotriarylmethane salt.

6. An imageable composition according to claim 5 wherein the sulfo salt group is oriented ortho to the methane carbon atom of the sulfoaminotriarylmethane salt.

7. An imageable composition according to claim 6 wherein said leuco dye is 1-(2-sulfophenyl)-bis(4-diethylamino-2-tolyl) methane sodium salt.

8. An imageable composition according to claim 1 wherein said hexaaromaticbiimidazole is asymmetric.

9. An imageable composition according to claim 8 wherein said hexaaromaticbiimidazole is 2-phenyl-2'-(2-tolyl)-4,4'-5,5'-tetraphenylbiimidazole.

10. An imageable composition according to claim 1 wherein said hexaaromaticbiimidazole is symmetric.

11. An imageable composition according to claim 10 wherein said hexaaromaticbiimidazole is 2,2'-bis(2-tolyl)-4,4',5,5'-tetraphenylbiimidazole.

12. An imageable composition according to claim 1 wherein said oxygen sensitizing compound is said polycyclic aromatic compound.

13. An imageable composition according to claim 12 wherein said oxygen sensitizing compound is ethylated trichloroviolanthrone.

14. An imageable composition according to claim 1 wherein said oxygen sensitizing compound is a porphyrin of the formula

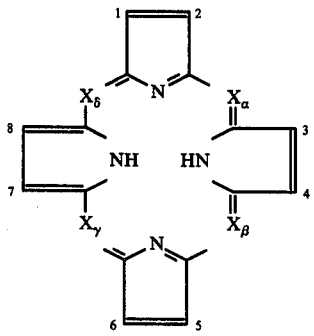

wherein X is selected from carbon and nitrogen wherein the carbon may have attached thereto hydrogen, alkyl containing from about 1 to 14 carbon atoms, aryl groups, and heterocyclic groups containing carbon, oxygen, nitrogen and sulfur.

15. An imageable composition according to claim 14 wherein said oxygen sensitizer is selected from tetraarylporphyrin and octaaryltetraazaporphyrin.

16. An imageable composition according to claim 15 wherein said sensitizer is tetraarylporphyrin.

17. An imageable composition according to claim 16 wherein said tetraarylporphyrin is $\alpha,\beta,\gamma,\delta$ tetraphenylporphyrin.

18. An imageable composition according to claim 15 wherein said sensitizer is octaaryltetraazaporphyrin.

19. An imageable composition according to claim 18 wherein said octaaryltetraazaphorphyrin is octaphenyltetraazaporphyrin.

20. An imageable composition according to claim 1 wherein said oxygen sensitizing compound is a prophyrin of the formula

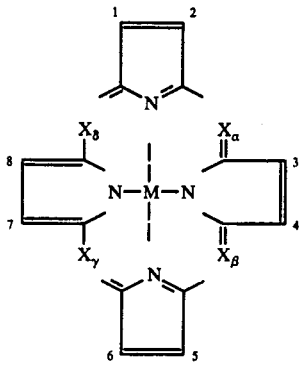

wherein X is selected from carbon and nitrogen wherein the carbon may have attached thereto hydrogen, alkyl containing from about 1 to 14 carbon atoms, aryl groups, and heterocyclic groups containing carbon, oxygen, nitrogen and sulfur and M is a metal which forms chelates with the pyrole nitrogens.

21. An imageable composition according to claim 1 wherein there is further included a film forming binder that is transmissive to said electromagnetic radiations.

22. An imageable composition according to claim 21 wherein there is further included a plasticizer.

23. A dimensionally stable sheet having applied to a surface thereof an imageable composition according to claim 1.

24. A film of an imageable composition according to claim 1.

25. A method of forming images comprising the steps of (a) providing a substrate having coated on at least one surface thereof an imageable composition according to claim 1; and (b) irradiating said imageable composition, in any order, to (i) electromagnetic radiation having wavelengths of from about 250 to 400 nanometers so as to effect the formation of color in the areas so irradiated and (ii) electromagnetic radiation having wavelengths of from about 400 to 700 nanometers so as to stabilize said leuco dye in the leuco form in the areas so irradiated, provided that the first of said irradiations is in an imagewise fashion.

* * * * *

UNITED STATES PATENT AND TRADEMARK OFFICE

CERTIFICATE OF CORRECTION

PATENT NO. : 4,090,877

DATED : May 23, 1978

INVENTOR(S) : RICHARD D. STREEPER

It is certified that error appears in the above-identified patent and that said Letters Patent are hereby corrected as shown below:

(Col. 3, line 31), "dimethylamine" should read --dimethylamino--.

(Col. 3, line 33), "diethylamine" should read -- diethylamino --.

(Col. 10, line 31), "$-OPO_3R_7^2$" should read -- $-OPO_3R_2^7$--.

(Col. 13, line 13), "liguid" should read --liquid--.

(Col. 19, line 2), "octaaryltetraazaphorphyrin" should read --octaaryltetraazaporphyrin--.

Signed and Sealed this

*Twenty-eighth* Day of *November 1978*

[SEAL]

*Attest:*

RUTH C. MASON
*Attesting Officer*

DONALD W. BANNER
*Commissioner of Patents and Trademarks*